US005499798A

United States Patent [19]

Witter et al.

[11] Patent Number: 5,499,798

[45] Date of Patent: Mar. 19, 1996

[54] REFRACTORY RETAINING APPARATUS

[75] Inventors: Jay W. Witter; Michael Slezak, both of Pittsburgh, Pa.

[73] Assignee: USX Corporation, Pittsburgh, Pa.

[21] Appl. No.: 199,660

[22] Filed: Feb. 22, 1994

[51] Int. Cl.[6] ..... C21C 5/46

[52] U.S. Cl. ..... 266/275; 266/282; 266/283

[58] Field of Search ..... 266/275, 276, 266/280, 283, 282; 432/248, 250, 252, 263, 264

[56] References Cited

U.S. PATENT DOCUMENTS

| | | | |
|---|---|---|---|
| 1,410,729 | 3/1922 | Balz | 266/283 |
| 3,203,688 | 8/1965 | Sieckman et al. | 266/283 |
| 3,422,857 | 1/1969 | Napora | 266/283 |
| 3,800,014 | 3/1974 | Brichard | 266/283 |
| 3,894,729 | 7/1975 | Muller | 266/280 |
| 4,079,184 | 3/1978 | Bahout et al. | 266/280 |
| 4,155,703 | 5/1979 | Mantey et al. | 266/280 |
| 4,900,249 | 2/1990 | McCollum et al. | 266/283 |
| 4,989,843 | 2/1991 | Dittrich et al. | 266/275 |
| 5,118,085 | 6/1992 | Forte et al. | 266/275 |

FOREIGN PATENT DOCUMENTS

| | | | |
|---|---|---|---|
| 7100228 | 7/1971 | Netherlands | 266/283 |

*Primary Examiner*—Scott Kastler
*Attorney, Agent, or Firm*—W. F. Riesmeyer, III

[57] ABSTRACT

An improvement is provided in apparatus for retaining refractory in a metallurgical vessel. The improvement includes a wedge-shaped metal ring extending along the inner periphery of a metal shell of the vessel adjacent to an opening at one end thereof and refractory material having an angular surface for abutting an angular surface of the metal ring.

3 Claims, 3 Drawing Sheets

REFRACTORY RETAINING APPARATUS

This invention relates to apparatus for retaining refractory in a metallurgical vessel, and particularly to an improvement in which a wedge-shaped metal ring located on an inner periphery of a metal shell of the vessel is abutted by refractory material of complementary angular shape.

Metallurgical vessels such as ladles typically have a metal outer shell lined with a number of courses of refractory bricks. These may be inner and outer layers of refractory bricks, the inner layer serving as a safety lining and the outer layer providing a service lining. The safety lining may be of relatively low quality refractory brick which does not need to be replaced very often. The service lining is of higher quality brick which is subjected to erosion and wear by molten metal and slag contained in the ladle and requires more frequent replacement. Structure is required adjacent an opening at one end of the ladle for retaining the refractory bricks in position. For example, the bricks would tend to fall out of the ladle when the ladle is tilted so that its open end faces downwardly toward the floor. Typically, the ladle was provided with a horizontal flange extending radially inwardly so as to partially enclose the open end of the ladle and provide an abutment for support of the refractory bricks. The flange tends to become warped due to exposure to the heat from the molten metal and is subject to damage and in need of frequent repair or replacement. More recently, a metal ring with a rounded exterior surface was provided adjacent the ladle opening and a refractory retaining brick having a complementary rounded recess filled with monolithic material was used as shown in U.S. Pat. No. 4,989,843. However, premature breakage of the brick was encountered due to the point loading between the metal ring and the recessed surface of the brick.

It is a primary object of this invention to overcome the difficulties of the prior art and to provide an improvement in refractory retaining means for metallurgical vessels.

SUMMARY OF THE INVENTION

This invention is of an improvement in refractory retaining means for use in a metallurgical vessel. The improvement comprises a metal ring of wedge-shape cross-section adapted to extend longitudinally along an inner periphery of a cylindrical metal shell of a metallurgical vessel adjacent to an opening at one end thereof. The metal ring has a first planar surface adapted to extend radially inwardly from the inner periphery of the cylindrical metal shell and in a plane substantially parallel to the plane of the opening at one end thereof. The metal ring has a second planar surface extending angularly at an acute angle from an inner edge of the first planar surface toward the inner periphery of the cylindrical metal shell at a position displaced and remote from the opening toward the interior of the vessel. Refractory material is provided having a first planar surface metable with the first planar surface of the metal ring so as to essentially form a radially inward extension thereof. The refractory has a second planar surface extending from the inner edge of the first planar surface thereof at an angle complementary to the angle of the second planar surface of the metal ring so as to become abutted thereagainst. Thus, the refractory and metal ring cooperate to form improved refractory retaining means for retaining refractory within the cylindrical metal shell of a metallurgical vessel.

DESCRIPTION OF THE PREFERRED EMBODIMENT

Figure 1:
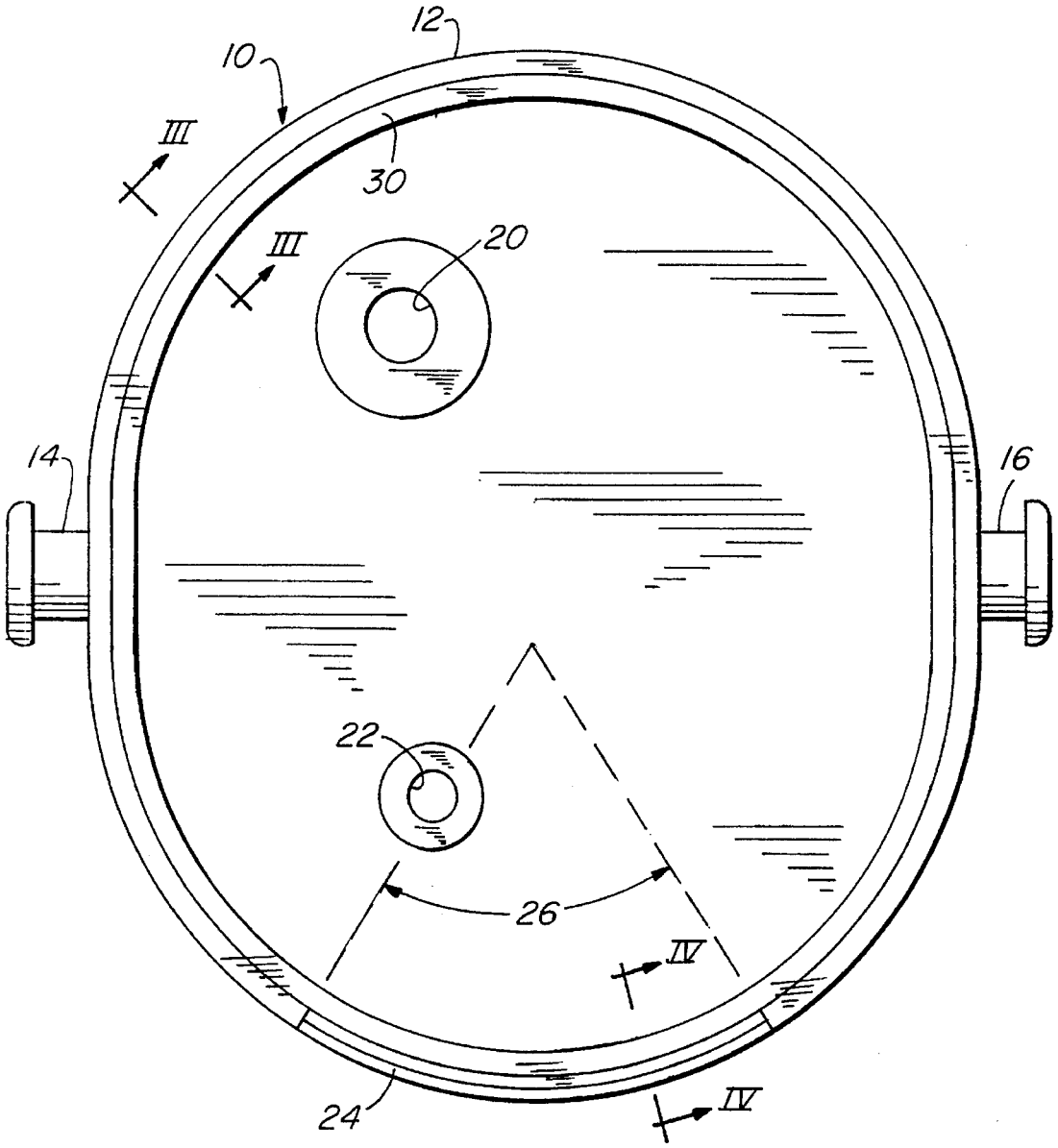
FIG. 1 is a plan view of a metallurgical ladle showing the metal ring which forms a part of the invention adjacent an opening in the top of the ladle.

Referring to FIG. 1, a ladle 10 is shown having an outer metal shell 12. The ladle has a pair of trunnions 14, 16 for engagement by crane hooks (not shown) so that the ladle can be lifted and transported from one place to another. The bottom 18 of the ladle has an opening 20 for receipt of a refractory nozzle well through which molten metal may be drained from the ladle. In the ladle shown, a second opening 22 is provided for receipt of a refractory plug through which argon gas may be bubbled to stir the molten metal. The upper edge of metal shell 12 has a readily replaceable flange 24 in an area 26 adjacent opening 22. The flange 24 is located in an area where slag is skimmed off the top of the molten metal in the ladle. The flange may be replaced when damage occurs due to exposure to the molten slag during skimming.

Figure 2:
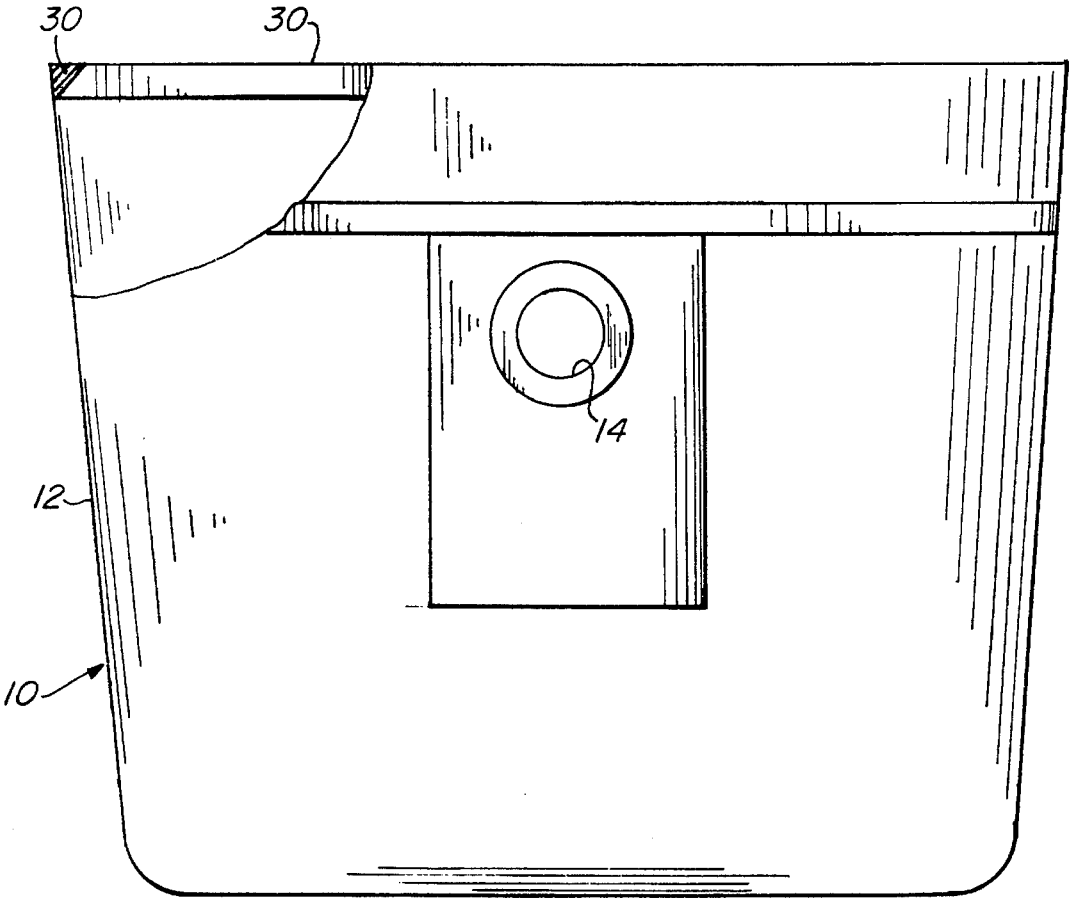
FIG. 2 is a side elevation view of the ladle shown in FIG. 1 with a partial cut away section showing the metal ring adjacent the opening at the top of the ladle.
Figure 3:
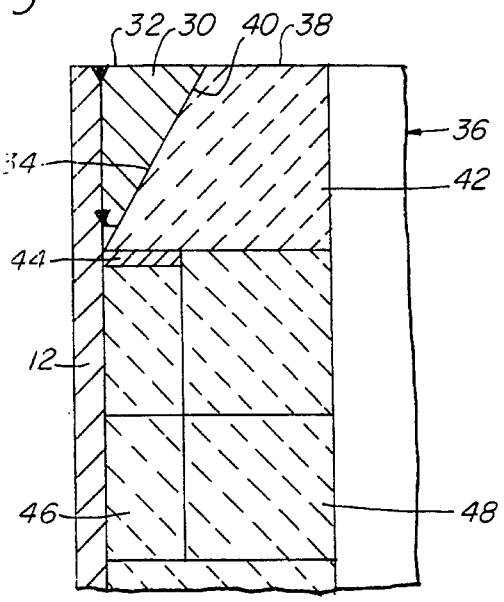
FIG. 3 is a section taken at III—III of FIG. 1 showing the metal ring and a refractory brick abutted against the metal ring for retaining the refractory in the ladle.

According to this invention, a metal ring 30 is provided on the metal shell 12 adjacent to the opening at the top of the ladle. Referring to FIG. 2, the metal ring 30 extends longitudinally along the inner periphery of the shell 12. The metal ring preferably consists of two substantially 180 degree segments with a small space provided between their adjacent ends to allow for thermal expansion of the ring. Referring to FIG. 3, the metal ring 30 is of wedge-shape cross section and has a first planar surface 32 and a second planar surface 34 aligned at an acute angle to the first planar surface. The metal ring may be a separate piece or integral with the metal shell of the ladle. Preferably, the second planar surface is aligned at an angle within the range of from about 15 to about 35 degrees with respect to the first planar surface, most preferably, the angle is about 25 degrees. Refractory material 36 is provided for cooperating with the metal ring 30. The refractory material 36 has a first planar surface 38 and a second planar surface 40. The first planar surface 38 of the refractory forms a radially inward extension of the first planar surface 32 of the metal ring. The second planar surface 40 of the refractory is aligned at an angle with respect to first planar surface 38 which is the complement of the angle formed between the first and second planar surfaces of the metal ring. Preferably, the refractory comprises a plurality of refractory bricks 42 laid side-by-side to form a ring of refractory for cooperating with the metal ring 30 to retain lower courses of refractory brick in the ladle. The bricks used in the area which is not subjected to slag being skimmed from the ladle may be an 85% phos bonded high alumina pressed brick. The bricks may be laid without a refractory cement or refractory cement may be used if desired. We generally do not use any cement between the bricks. Again, although it is not required, an underpinning ledge 44 may be provided to help retain the bricks in the safety lining 46 in place. The service lining 48 is retained by the apparatus of this invention. According to this invention, the abutted second planar surfaces 34 and 40 of the metal ring and refractory, respectively, serve to retain the refractory in position and prevent it from falling out of the ladle when it is turned upside down.

Figure 4:
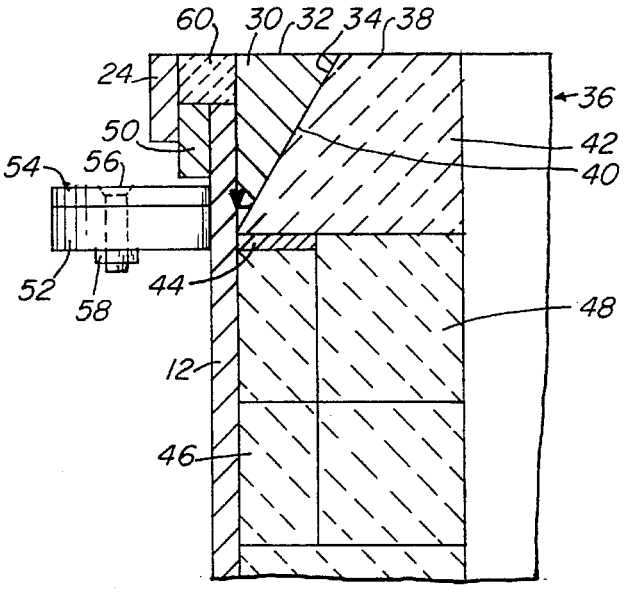
FIG. 4 is a section taken at IV—IV of FIG. 1 showing the metal ring and refractory brick in an area where slag is skimmed from the ladle, a portion of the metal shell being offset for ease of repair and replacement.

Referring to FIG. 4, the invention is shown in area 26 where slag is skimmed off the top of molten metal in the ladle. A separate flange 24 is provided at the upper edge of metal shell 12. The flange is welded to a spacer bar 50 which in turn is welded to the shell. A rib 52 is provided with a wear bar 54 attached thereto by a bolt 56 secured by nut 58. Refractory material 60 is pressed behind metal ring 30 to permit slag to pass over the flange 24. Flange 24 may be replaced readily as wear occurs due to exposure to the slag. The refractory bricks 42 in the area subjected to slag being skimmed from the ladle may preferably be of a 5% carbon pitch bonded pressed carbon magnesite brick.

Figure 6:
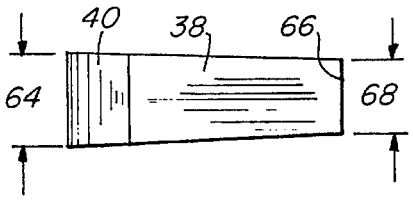
FIG. 6 is a plan view of the refractory brick shown in FIG. 5.
Figure 5:
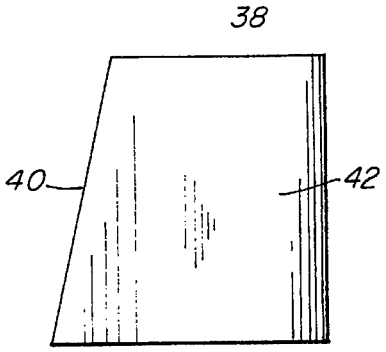
FIG. 5 is an enlarged side elevation view of the refractory brick which forms a part of the retaining means of this invention.

Referring to FIGS. 5 and 6, the refractory brick which forms a part of this invention is shown in enlarged detail. Although it is not part of the present invention, the brick is tapered from an inner end 62 of relatively larger width 64 to an outer end 66 of narrower width 68. The tapered configuration of the bricks provides additional locking forces when the bricks are laid in side-by-side relation so that they will not tend to fall radially inwardly even before the bricks are preheated.

It will be apparent to those skilled in the art that various modifications may be made in the apparatus above described without departing from the spirit and scope of the invention as set forth in the appended claims.

We claim:

1. In a metallurgical vessel having an essentially cylindrical metal shell with an opening at one end thereof, means for retaining refractory in said cylindrical metal shell, the improvement in which said refractory retaining means comprises:

a metal ring of wedge-shape cross section extending longitudinally along an inner periphery of the cylindrical metal shell adjacent to the opening at one end thereof, said metal ring having a first planar surface extending radially inwardly from the inner periphery of the cylindrical metal shell in a plane substantially parallel to the plane of the opening at one end thereof, said metal ring having a second planar surface extending angularly at an acute angle from an inner edge of the first planar surface toward the inner periphery of the cylindrical metal shell at a position displaced and remote from the opening at one end thereof, and refractory material having a planar surface extending at an angle complementary to the angle of the second planar surface of said metal ring so as to become abutted thereagainst, thus retaining the refractory material in said cylindrical metal shell.

2. The improvement of claim 1 in which said refractory material comprises a plurality of refractory bricks.

3. The improvement of claim 1 in which the second planar surface of the metal ring is aligned at an angle within the range of from about 15 degrees to about 30 degrees with respect to the first planar surface of said metal ring.

* * * * *